US006116582A

United States Patent [19]

Kärnä et al.

[11] Patent Number: 6,116,582

[45] Date of Patent: Sep. 12, 2000

[54] MIXER FOR MIXING TWO FLUIDS IN A CONTAINER HAVING A HOLLOW ROTOR WITH A PERVIOUS PORTION AND A LIQUID SEAL COVERING A NON-PERVIOUS ROTOR PORTION

[75] Inventors: Juhani Kärnä; Heikki Vartiala, both of Helsinki, Finland

[73] Assignee: Overcraft Oy, Helsinki, Finland

[21] Appl. No.: 09/125,079

[22] PCT Filed: Feb. 18, 1997

[86] PCT No.: PCT/FI97/00103

§ 371 Date: Aug. 12, 1998

§ 102(e) Date: Aug. 12, 1998

[87] PCT Pub. No.: WO97/29840

PCT Pub. Date: Aug. 21, 1997

[30] Foreign Application Priority Data

Feb. 19, 1996 [FI] Finland ..... 960744

[51] Int. Cl.[7] ..... B01F 3/04

[52] U.S. Cl. ..... 261/83; 261/121.1; 261/122.1; 261/123; 261/124; 210/220

[58] Field of Search ..... 96/332, 342, 343, 96/344, 345, 346, 351, 352, 353, 354; 261/83, 85, 87, 91, 36.1, 93, 121.1, 122.1, 123, 124, 34.1; 210/220

[56] References Cited

U.S. PATENT DOCUMENTS

| | | | |
|---|---|---|---|
| 2,733,056 | 1/1956 | Marky | 261/87 |
| 2,928,665 | 3/1960 | Epprecht | 261/93 |
| 3,409,130 | 11/1968 | Nakamura | 261/93 |
| 4,166,086 | 8/1979 | Wright | 261/93 |
| 4,919,849 | 4/1990 | Litz et al. | 261/93 |

FOREIGN PATENT DOCUMENTS

| | | | |
|---|---|---|---|
| 0048088 | 3/1982 | European Pat. Off. | 261/83 |
| 944613 | 11/1994 | Finland . | |
| 880939 | 4/1943 | France | 261/83 |
| 9319836 | 10/1993 | WIPO . | |

OTHER PUBLICATIONS

Abstract of FI 944613 dated Nov. 1994.

*Primary Examiner*—David A. Simmons
*Assistant Examiner*—Robert A. Hopkins
*Attorney, Agent, or Firm*—Ladas & Parry

[57] ABSTRACT

The present invention relates to a mixer for mixing two fluids, the mixer comprising a power source (5) with a rotating transmission shaft (7), a hollow rotor (6) to be submerged in a first fluid (8) and arranged to rotate with the shaft, wherein at least one end of the rotor comprises an opening or openings for supply of a second fluid (9) to the hollow rotor (6), and jet openings (10) are provided in the side surface of the rotor through which the second fluid (9) is discharged into the first fluid (8) surrounding the rotor. To achieve a better operating efficiency, the mixer has a tight liquid seal (14) shaped to cover and isolate substantially the entire portion of the rotor that is above the first fluid.

17 Claims, 2 Drawing Sheets

MIXER FOR MIXING TWO FLUIDS IN A CONTAINER HAVING A HOLLOW ROTOR WITH A PERVIOUS PORTION AND A LIQUID SEAL COVERING A NON-PERVIOUS ROTOR PORTION

FIELD OF THE INVENTION

The present invention relates to a mixer for mixing two fluids, the mixer comprising a container provided with a cover, a bottom and side walls for receiving fluids; a power source with a transmission shaft; a hollow rotor mounted on the transmission shaft and partially submerged in a first fluid in the container, the rotor having a side surface and at least one end surface intersecting the transmission shaft substantially perpendicularly and having one end that comprises at least one opening for supply of a second fluid to the hollow rotor, at least part of the side surface of the rotor being pervious to the second fluid, through which side surface the second fluid can be discharged into the first fluid at least partially surrounding the rotor; means for supplying the second fluid to the rotor through the apertured end thereof, and a discharge tube for discharging the fluid from the container.

BACKGROUND

The concept of a fluid in this application generally refers to fluid mediums, for example gases, liquids and the like. The present invention specifically relates to a mixer with which preferably oxygen or an oxygen-carrying gas is injected, in the form of bubbles, into water in a container to enhance the removal of deleterious substances, such as radon, from the water.

Previously known are various methods and devices specifically for the removal of radon mainly from household water and from water used in institutions by aerating the water mass run into the device. However, this conventional art is related with considerable disadvantages. Hence, the known devices have poor efficiency, may have microbial growth that is deleterious to health, and may accumulate radioactivity which makes them hazardous waste. Also, these devices are space-consuming, inefficient and awkward to use and to service.

SUMMARY OF THE INVENTION

It is an object of the present invention to remove the drawbacks of the prior art and to provide a completely novel solution, enabling easy use of the device of the invention in households and at other locations without any health hazards, without the device taking up too much space or requiring technically highly skilled users. Furthermore, the solution in accordance with the invention aims at providing a device with which deleterious substances are quickly and efficiently removed from a first fluid run into the device.

This object is achieved in such a way that in accordance with the invention, the mixer has the characteristics defined in the appended claims. More specifically, the device of the invention is primarily characterized in that a liquid seal extending from the cover of the container beneath the surface of the first fluid is provided in the container, the liquid seal surrounding the rotor immediately adjacent thereto and being shaped to cover substantially the entire portion between the rotor cover and the first fluid as it extends beneath the surface of the first fluid, and that the end of the rotor facing the cover is open substantially for its entire area for supply of a second fluid to the rotor.

The invention is based on the idea that producing a large amount of gas bubbles, such as air bubbles, in the first fluid, such as water, enables efficient removal of deleterious gases from the first fluid, such as water.

When the upper portion of the rotor in the device is substantially isolated from the second fluid surrounding it, the second fluid flowing into the device and discharged through the rotor into the first fluid in the device are not mixed with the second fluid that is already present in the upper portion of the device and is surrounded by the liquid seal.

With the solution in accordance with the invention, no separate compressor or other equipment is needed to supply the second fluid to the first fluid. Furthermore, the rotor structure in accordance with the invention considerably diminishes the power requirement for the power source driving the rotor as it diminishes the wet surface of the rotor that is in contact with the first fluid since the end surface of the rotor is substantially isolated from the ambient first fluid and since the upper portion of the rotor is entirely in contact with the second fluid only.

In a preferred embodiment of the mixer in accordance with the invention, one or more guide vanes are provided adjacent the side surface of the rotor. The guide vane ensures that the fluids or the mixture thereof surrounding the rotor are replaced, i.e. it produces a uniform flow through the side surface of the rotor, thus increasing the pressure difference between the interior and exterior of the rotor, which will further enhance the discharge of the second fluid from the rotor. Furthermore, the guide vane converts the mixing of the second fluid and first fluid from horizontal to vertical and subsequently to radial.

The preferred embodiments of the mixer of the invention are apparent from the appended dependent claims.

BRIEF DESCRIPTION OF THE DRAWINGS

The invention will be described in greater detail in the following by way of example by means of a preferred embodiment of the invention with reference to the accompanying drawings, in which.

DETAILED DESCRIPTION

The figures show a preferred embodiment of a mixer in accordance with the invention. Such a mixer can be used for example for mixing gas into a liquid, for mixing two gases of different weights or for scrubbing gas by means of a liquid in a container.

An advantageous use for the invention is for removing radon from water. In such a case, the device achieves bonding of radon to gas bubbles, e.g. air, created in the water. The radon bonded to the gas bubbles is removed on account of the pressure created in the device.

Figure 1:
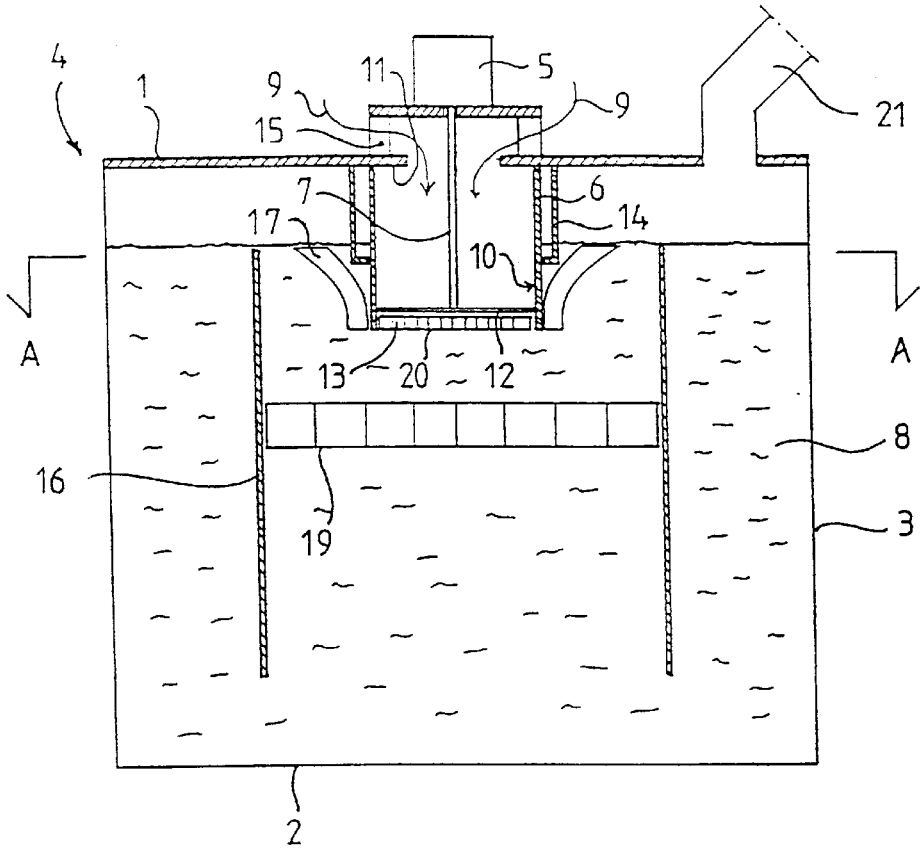
FIG. 1 shows a vertical section of a preferred embodiment of a mixer in accordance with the invention.

The mixer of the invention as shown in FIG. 1 comprises a container provided with a cover 1, a bottom 2 and side walls 3. A power source 5, preferably e.g. an electric motor, and a rotor 6 are arranged in connection with the container.

The rotor is fixed for rotation with the transmission shaft 7 of the power source. The rotor 6 is at least partially submerged in a first fluid 8, e.g. water, where it is used to mix a second fluid 9, e.g. air, with the water by rotating the rotor by means of the power source 5.

The rotor 6 as shown in the figures comprises a substantially cylindrical member the lower portion of which comprises jet openings 10 covered by a mesh or a perforated plate or any known porous or fluid-pervious layer or sheet. The portion of the side surface of the rotor that lies beneath the surface of the first fluid can also be constructed of a mesh or a porous material that is pervious to the second fluid. The structure of the side surface of the rotor enables the second fluid to pass from within the rotor through the side surface to the first fluid exterior of the rotor.

Figure 3:
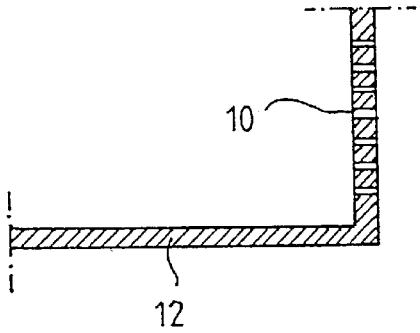
FIG. 3 shows a detail of an embodiment of the juncture of the side surface and end surface of the rotor.
Figure 4:
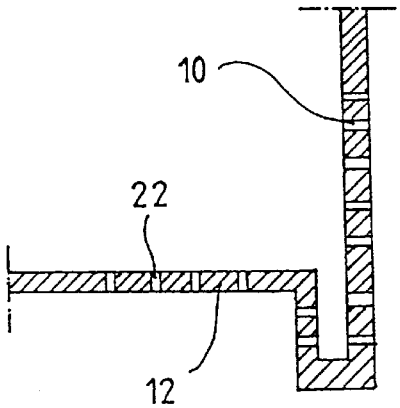
FIG. 4 shows a detail of another embodiment of the juncture of the side surface and end surface of the rotor.
Figure 2:
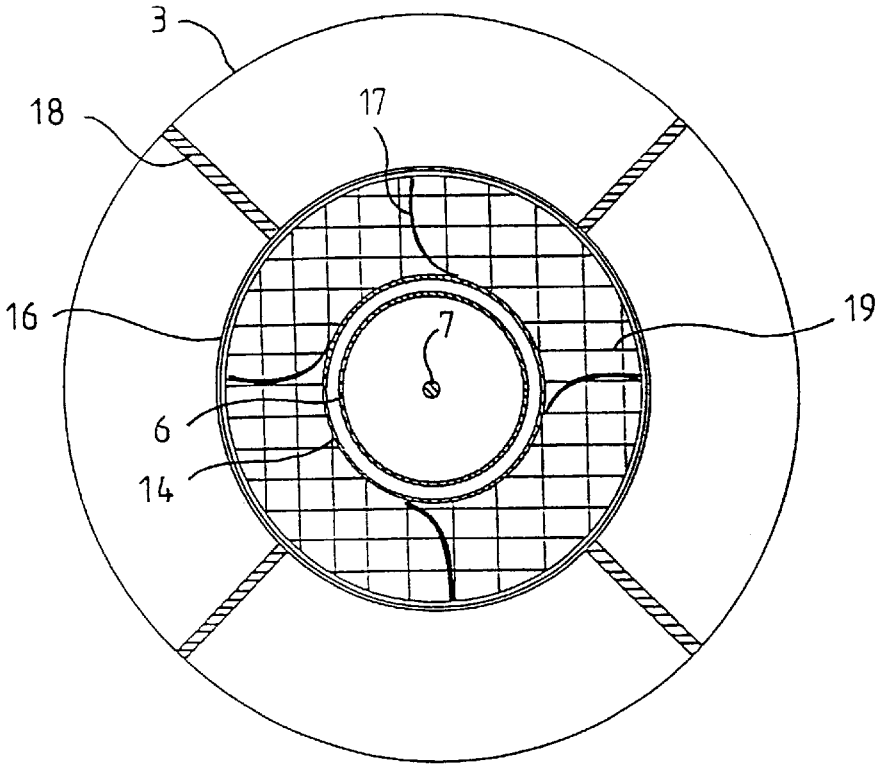
FIG. 2 shows a horizontal section A—A of the invention in accordance with FIG. 1.

The end surface 11 of the rotor facing the power source 5 is open or apertured. The end surface 12 of the rotor facing away from the power source is impermeable as it concurs with the side surface of the rotor as shown in FIG. 3. When it is desired to influence favourably the economy or utility of the device, the energy consumption of the device can be lowered by providing a tight base 13 by means of the side surface extending past and below the end surface 12. The end surface may also have apertures for supply of the second fluid and for producing a gas bed at the tight base. The side surface of the rotor surrounding the tight base may be with or without jet openings, as shown in FIG. 4. This tight base 13 provided below the rotor fully isolates the rotor 6 from the first fluid beneath it through the gas bed that is produced.

The device of the invention comprises a cylinder extending from the container cover 1 beneath the surface of the first fluid 8. The cylinder surrounds the rotor 6 immediately adjacent thereto, providing a liquid seal 14 in the region of the rotor for the first fluid, e.g. water. To improve the efficiency of the device, a horizontal sealing ring surrounding the rotor can be mounted on the lower edge of the liquid seal.

A second fluid 9, e.g. air, flows into the rotor 6 through at least one opening or other means 15 for supply of fluid, which is provided in the cover 1. The rotor is rotated through a transmission shaft 7 connected to the power source. On account of the pressure difference caused by the rotation, the second fluid, air, is discharged through the jet openings 10 and the surrounding mesh or apertured plate or the like into the ambient fluid. This reaction follows Bernoulli's theorem. The pressure difference created is directly proportional to the square of the product of the speed of rotation of the rotor and the length of the circumference of the rotor, and hence the quantity of gas discharged can be steplessly regulated by changing the above variables to be appropriate in each case.

Where the outer dimensions and speed of rotation of the rotor 6 are suitably designed, the desired pressure difference between the inner and outer surface of the rotor is created, which causes the second fluid to flow into the first fluid and to create bubbles, and hence the device of the invention has no need for a compressor or other means for conveying the second fluid, e.g. air, to the rotor and further to the first fluid, e.g. water.

To enhance the mixing of the fluids, the container is divided into two compartments by a tubular member 16, i.e. a riser. The riser extends substantially from the surface of the first fluid down to the vicinity of the bottom of the device, so that a gap connecting the interior and exterior of the riser remains between the bottom and the lower edge of the riser. The riser may also extend down to the bottom of the device; in that case, the wall of the riser is provided with at least one opening in the vicinity of the bottom, providing a flow passage for the first fluid.

In such a case, the rotor 6 is located within the riser. Guide vanes 17 are provided immediately adjacent the rotor, converting the horizontal circulating motion of the bubble-rich water into vertical and further into radial movement, which forces the bubbled water to discharge through the upper end of the riser. This produces a vertical movement from the surface of the first fluid towards the bottom of the device and a circulating motion in the direction of the rotor in the container 4. By providing a round-off at the upper end of the riser, a maximally laminar flow over the upper end of the riser is created.

As the rotor 6 produces in the water 8 a vortex having the direction of a tangent of the side wall 3 of the device, it is advantageous to provide in the device vertical plate-like members 18 between the riser 16 and the side wall 3 of the container, arresting the vortex in the water.

The rotating movement of the rotor also produces a vortex in the water located in the riser 16 below the rotor; this will be arrested for example by means of an equalizing grid 19 constructed of lameliae or a corresponding structure provided with substantially vertical walls. The wall surfaces of such a grid are substantially vertical or at a suitable angle to the vortex, as necessary.

The tight base 13 provided in the portion of the rotor facing away from the power source 5 prevents the rotor from contact with the first fluid, e.g. water, below, on account of the gas bed produced at the base. This gas bed serves as a kind of slide bearing, diminishing the friction between the rotor and the water and thereby saving energy. As a result of the turbulence produced by the rotor, the gas bed tends to break and water tends to ingress the end surface 12. To keep the gas bed intact, it is advantageous to provide the device with gas retention means 20, such as a grid slightly distanced from the tight base, preventing any turbulence from being produced, or with a lid portion preventing the gas from escaping from the tight base. A funnel wherewith the gas, such as air, that has entered the riser 16 can be captured and conveyed further to the tight base 13 may also be employed in the device.

It is also possible to provide a perforation 22 in the region of the base 13, as shown in FIG. 4, in the end surface 12 and/or the lower portion of the side surface of the rotor. In this case, gas will be discharged through the perforation to the tight base in accordance with Bernoulli's theorem.

As will be seen from FIG. 1, the only moving parts in the device of the invention are the rotor and the transmission shaft 7 fixed thereto, with its motor. Hence, the device has very few moving, and thereby wearing, parts, in practice only the motor bearings, and thus it barely needs any maintenance. By providing guide vanes 17 in connection with the rotor of the device, the movement of the bubble-rich water in the container 4 is intensified, and thus the gas bubbles and for instance the radon bonded to them are more effectively removed from the water and discharged from the device through its discharge tube 21. The guide vanes 17 enhance the exchange of fluid at the jet openings of the side surface. Such a guide vane may be flat, convex or three-dimensional, i.e. biconvex. By providing breaking means or meshes in connection with the guide vanes above them, on which means the water-air mixture impinges upon exiting the guide vane, the removal of gas bubbles and for example radon from the water is further enhanced.

In tests carried out, excellent results were achieved in removing radon from water. The tests employed a container 4 having a volume of about 600 liter, and to this container a rotor 6 was arranged in such a way that the mesh, apertured plate or other side surface thereof coming into contact with the water had a height of about 50 mm, and the liquid seal 14 extended 20 mm beneath the water surface, being tightly joined at its upper end with the cover 1 of the container 4. The device comprised a rotor 6 having a diameter of 165 mm; the rotor was rotated at speeds of 2550 and 2700 rpm. The diameter of the riser 16 surrounding the submerged portion of the rotor was 350 mm and its height 600 mm.

In the first test, a bubble jet diminished the radon content from an initial value of 13.000 Bq to 9.200 Bq, and conveying the water through a rotating rotor diminished the radon content further to 1.500 Bq. When 1 mm was selected as the size of the jet openings of the rotor, the radon content of the water was diminished to 300 Bq in 6 minutes 25 seconds and to 10 Bq in 25 minutes in accordance with Chart 1 below.

CHART 1

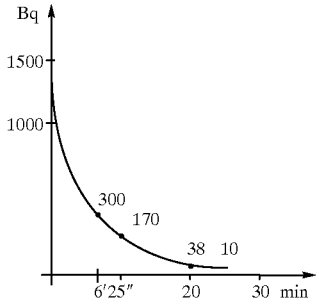

When in another test 520 liter of water were drawn off cautiously directly from the water mains into a container, the radon content of the water measured from the container was about 17.000 Bq/l. When 0.5 mm was selected as the size of the jet openings, in accordance with Chart 2 below the radon content of the water decreased to 300 Bq already in about 7 minutes, which is the official recommendation for a safe limit for the radon content for water used in households and institutions.

CHART 2

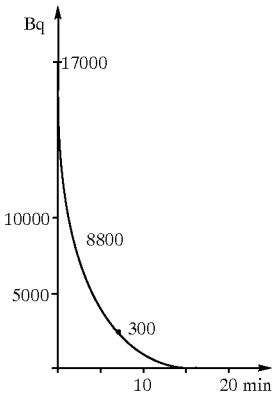

It is to be understood that the above description and the figures pertaining thereto are only intended to illustrate the present invention. The invention is therefore not restricted to the embodiment presented above or defined in the claims, but different variations and modifications of the invention, which are possible within the scope of the inventive idea defined in the appended claims, will be apparent to those skilled in the art.

Hence, the device of the invention can be used for removing radon from drinking water in accordance with the above, and also for efficient scrubbing of contaminated air, since in the device a large amount of a second fluid is conveyed through a first fluid, e.g. water, lime milk etc., in the device. The device can also be successfully used for normal aeration of water, for example at wastewater treatment plants, fishery plants and plants culturing other aquatic fauna, and so on. The device may even be used to replace electric filters in the flue gas scrubbers of coal, oil and other power plants and for example in the mining industry for pre-concentration or post-concentration of liquefied concentrate. The invention will also be likely to find application in the food and chemical industries.

What is claimed is:

1. A mixer for mixing two fluids, said mixer comprising a container for receiving fluids, said container being provided with a cover, side walls and a bottom, a power source with a transmission shaft, a hollow rotor mounted on the transmission shaft and partially submerged in a first fluid in the container, said hollow rotor including a portion extending through and outside said cover, said rotor having a side surface and one end extending perpendicularly to said shaft within said first fluid and a second end outside said cover provided with an opening for supply of a second fluid into said hollow rotor, at least part of the side surface of the rotor being pervious to said second fluid for discharge of said second fluid into said first fluid in which said rotor is submerged, a fluid discharge tube connected to said container, and a liquid seal extending from said cover into said first fluid, said liquid seal being adjacent to and surrounding said rotor in a region of the rotor extending from said cover into said first fluid to cover a portion of said rotor extending out of said first fluid and a portion of said rotor which is submerged in said first fluid, said portion of the rotor extending outside said cover being substantially open to provide said opening for supply of said second fluid into the rotor.

2. A mixer as claimed in claim 1, wherein the side surface and said one end of the rotor form a fluid-tight base on the rotor remote from said power source and substantially isolating said rotor from the first fluid.

3. A mixer as claimed in claim 1, wherein the rotor is substantially cylindrical in shape.

4. A mixer as claimed in claim 1, wherein said rotor has a portion extending between a lower edge of the liquid seal and said one end which is provided with a jet outlet pervious to said second fluid for discharge of said second fluid into said first fluid.

5. A mixer as claimed in claim 4, wherein said jet outlet comprises an opening in said portion of said rotor extending between the lower edge of the liquid seal and said one end of the rotor and a cover over said opening which is pervious to said second fluid.

6. A mixer as claimed in claim 4, said portion of said rotor extending between the lower edge of the liquid seal and said one end of the rotor comprises a side surface pervious to said second fluid to form said jet opening for said second fluid.

7. A mixer as claimed in claim 6, wherein said side surface is reticular.

8. A mixer as claimed in claim 6, wherein said side surface is made of a material pervious to said second fluid.

9. A mixer as claimed in claim 1, comprising a guide vane extending from said side surface of the rotor into said first fluid in a radially outwards direction.

10. A mixer as claimed in claim 2, wherein said second fluid is a gas, said mixer further comprising gas retention means secured to said container adjacent to said fluid-tight base of said rotor.

11. A mixer as claimed in claim 10, wherein said gas retention means comprises a grid.

12. A mixer as claimed in claim 2, wherein said fluid-tight base is provided with a perforation for escape of said second fluid therethrough.

13. A mixer as claimed in claim 1, comprising a tubular member extending from a surface of the first fluid to a distance from the bottom of the container, said tubular member extending between the side walls of the container and the side surface of said rotor.

14. A mixer as claimed in claim 13, comprising a straightening element provided in the tubular member between said end of the rotor and the bottom of the container.

15. A mixer as claimed in claim 14, wherein said straightening element comprises an equalizing grid.

16. A mixer as claimed in claim 13, comprising substantially vertical plate-like walls between said tubular member and the side walls of the container.

17. A mixer as claimed in claim 1, wherein the first fluid is water containing radon gas and the second fluid is air.

* * * * *